US007260234B2

(12) United States Patent
Kasztelan et al.

(10) Patent No.: US 7,260,234 B2
(45) Date of Patent: Aug. 21, 2007

(54) SPACE-SAVING ANTENNA ARRANGEMENT FOR HEARING AID DEVICE

(75) Inventors: Thomas Kasztelan, Erlangen (DE); Torsten Niederdränk, Erlangen (DE); Peter Nikles, Erlangen (DE); Christian Weistenhöfer, Bubenreuth (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 219 days.

(21) Appl. No.: 10/634,975

(22) Filed: Aug. 5, 2003

(65) Prior Publication Data

US 2004/0028251 A1 Feb. 12, 2004

(30) Foreign Application Priority Data

Aug. 12, 2002 (DE) ..... 102 36 940

(51) Int. Cl.
*H04R 25/00* (2006.01)

(52) U.S. Cl. ..... 381/324; 381/315; 381/322; 381/189

(58) Field of Classification Search ..... 381/322, 381/324, 317, 367, 94, 94.1, 94.7, 71.6, 71.11, 381/71.14, 71.2, 331, 315; 379/52, 443, 379/394, 390.04; 455/129, 269, 41.1, 41.2; 343/895, 788

See application file for complete search history.

(56) References Cited

U.S. PATENT DOCUMENTS 3,396,245 A * 8/1968 Flygstad ..... 381/331
4,596,899 A * 6/1986 Wojcik et al. ..... 379/52
5,195,142 A * 3/1993 D'Avolio et al. ..... 381/173
5,809,151 A * 9/1998 Husung ..... 381/322
6,466,679 B1 * 10/2002 Husung ..... 381/324
6,694,034 B2 * 2/2004 Julstrom et al. ..... 381/315

FOREIGN PATENT DOCUMENTS

| | | |
|---|---|---|
| DE | 43 19 599 | 8/1994 |
| DE | 43 26 358 | 11/1994 |
| DE | 690 31 432 | 3/1998 |
| DE | 198 54 201 | 5/2001 |
| DE | 199 15 558 | 10/2001 |
| EP | 0 686 985 | 9/1997 |

* cited by examiner

*Primary Examiner*—Curtis Kuntz
*Assistant Examiner*—P. Dabney
(74) *Attorney, Agent, or Firm*—Schiff Harin LLP

(57) ABSTRACT

An antenna coil is present in a hearing aid device to wirelessly transmit signals between a hearing aid device and a further device. Due to the required miniaturization of hearing aid devices, only minimal space is available for the arrangement of the antenna coil in the hearing aid device. The invention therefore provides for winding the antenna coil around or on an existing electro-acoustic transducer in the hearing aid device or around a capsule surrounding the transducer. A comparatively large antenna coil, for which little additional space is required, can thereby be provided in the hearing aid device.

15 Claims, 3 Drawing Sheets

SPACE-SAVING ANTENNA ARRANGEMENT FOR HEARING AID DEVICE

BACKGROUND OF THE INVENTION

1. Field of the Invention

The invention concerns a hearing aid device with at least one microphone to acquire an acoustic input signal and transduce it into an electrical signal, a signal processing unit to process the electrical signal, an earpiece to transduce the electrical signal into an acoustic signal and, with an antenna coil, to wirelessly transmit data between the hearing aid device and a further device.

Furthermore, the invention concerns a hearing aid device with at least one microphone to acquire an acoustic input signal and transduce it into an electrical signal, a signal processing unit to process the electrical signal, an earpiece to transduce the electrical signal into an acoustic signal and, with an antenna coil, to wirelessly transmit data between the hearing aid device and a further device, whereby the earpiece is enclosed by at least one shielding plate or one shielding capsule.

2. Description of the Related Art

A hearing aid with an inductive coil is known from German patent document DE 43 19 599 C1, the coil being arranged embedded in a recess in a printed circuit board.

A sound transducer for hearing aids is known from German patent document DE 690 31 432 T2, in which a coil is attached on a flexible carrier.

A regulating implant to normalize cerebro-spinal fluid pressure is known from German patent document DE 199 15 558 C2, in which an antenna is arranged on the surface of a chip.

An induction coil for hearing aids is known from German patent document DE 43 26 358 C1 which comprises a coil body made from mu-metal.

A hearing aid device is known from German patent document DE 198 54 201 C2, with an earpiece to deliver sound, an induction coil to inductively acquire signals, and a compensation inductor to generate a compensation field, in that the compensation inductor is positioned in the signal line of the earpiece between the induction coil and the earpiece, such that its compensation field is directed against the magnetic field upon operation of the induction coil, and a coupling between the earpiece and the induction coil is decreased.

An "earpiece", used in hearing aid devices, works for the most part according to the electromagnetic principle. Additionally, a magnetic circle is generated in the earpiece. Unfortunately, small magnetic leakage fields are also radiated into the external space. These undesired noise fields lead to interaction with the coils and conductors around the earpiece. It is therefore preferable to constrain or compensate the earpiece fields in the earpiece housing.

SUMMARY OF THE INVENTION

The object of the present invention is to minimize the space requirements of an antenna coil for the wireless transmission of data in a hearing aid device.

The object is achieved in a hearing aid device with at least one microphone to acquire an acoustic input signal and transduce it into an electrical signal, a signal processing unit to process the electrical signal, an earpiece to transduce the electrical signal into an acoustic signal and, with an antenna coil, to wirelessly transmit data between the hearing aid device and a further device, in that the antenna coil is wound around or on the earpiece.

Furthermore, the object is achieved in a hearing aid device with at least one microphone to acquire an acoustic input signal and transduce it into an electrical signal, a signal processing unit to process the electrical signal, an earpiece to transduce the electrical signal into an acoustic signal and, with an antenna coil, to wirelessly transmit data between the hearing aid device and a further device, whereby the earpiece is enclosed by at least one shielding plate or one shielding capsule, in that the antenna coil is wound around or on the shielding plate or the shielding capsule.

The invention offers the advantage that little additional space is required in the hearing aid device due to the antenna coil wound around or on the earpiece or microphone. A further advantage of the invention is that the electromagnetic signal transmitted from the earpiece to the antenna coil is, for the most part, a very well defined noise signal acquired by the antenna coil. Given an antenna coil wound around the earpiece, the signal transmission behavior between the earpiece and the antenna coil can be detected exactly, which enables a good compensation of the signal transmitted by the earpiece.

DESCRIPTION OF THE DRAWINGS

The invention is subsequently more closely specified using exemplary embodiments described below and shown in the drawings.

DETAILED DESCRIPTION OF THE PREFERRED EMBODIMENTS

Figure 1:
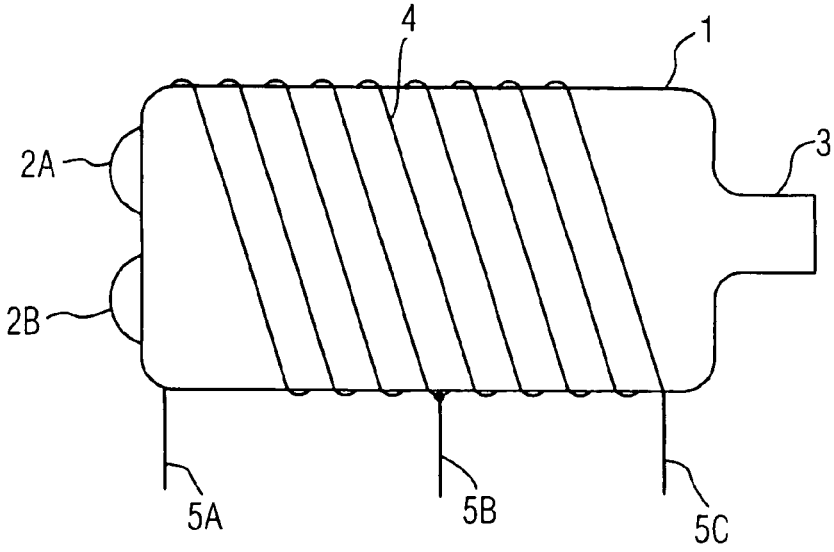
FIG. 1 is a pictorial diagram showing an earpiece around and on which an antenna coil is wound.

The various embodiments of the invention are described as follows. An embodiment of the invention provides a compensation coil to compensate the electromagnetic field generated by the earpiece. An electromagnetic field is generated by the compensation coil that is oriented contrary to and compensates the electromagnetic field generated by the earpiece in the region of the antenna coil.

The compensation coil is advantageously wound around the earpiece or the microphone or the shielding plate or the shielding capsule. This compensation coil also requires little additional space in the hearing aid device. However, the compensation coil can also not be wound around the earpiece, but rather be arranged, for example, in front of the earpiece. If the compensation coil is wound around the earpiece, it can thus be located above or below the antenna coil.

In an embodiment of the invention, the antenna coil and the compensation coil are implemented as a coil with a center tap. This simplifies and makes cheaper the production of the hearing aid device according to the invention.

A further embodiment of the invention provides an electric compensation circuit that can be implemented as both an external circuit and as an integrated circuit (IC) in a hearing aid device, in connection with the compensation coil to compensate the electromagnetic signal transmitted from the hearing aid device to the antenna coil. The electric earpiece input signal is preferably supplied directly to the compensation circuit. This is modified in the compensation circuit according to amplitude and/or phase and supplied to the compensation coil. This effects a particularly effective compensation of the noise signal generated by the earpiece.

The compensation circuit can be implemented as an active or passive filter. Furthermore, the filter parameters of this compensation circuit can be either statically chosen or adaptively adjusted during the operation.

During the above-described compensation of the widespread destructive interference of the undesired magnetic field generated by the earpiece within the antenna coil, this compensation can, in a further embodiment of the invention, also ensue electrically via a corresponding signal processor in the hearing aid device, before delivery of the earpiece signal. In addition, the hearing aid device preferably comprises a subtraction filter in which the earpiece input signal is processed and the present electric antenna signal is removed. A compensation that does not influence the magnetic field of the earpiece is implemented via this internal compensation method via an electronic signal processor. This type of compensation therefore also presents a very energy efficient solution.

The invention can be applied to all known hearing aid device types, for example, in hearing aids that can be worn behind the ear, hearing aids that can be worn in the ear, implantable hearing aids, or pocket hearing aids. Furthermore, the hearing aid device according to the invention can also be part of a plurality of devices comprising a hearing aid system for treating a person hard of hearing, for example, part of a hearing aid system with two hearing aids worn on the head for binaural treatment, or part of a hearing aid system comprised of a device that can be worn on the head and a processor unit that can be worn on the body.

Referring now to the embodiments shown in the drawings, FIG. 1 shows an electro-acoustic transducer fashioned as an earpiece 1. The earpiece 1 comprises on its one side the two electrical contacts 2A and 2B, via which an electric input signal is supplied to the earpiece 1. On the opposite side is located a noise emission connector 3, via which an acoustic output signal is emitted. The housing of the earpiece 1 is preferably comprised from an iron plate which largely prevents an emission of electromagnetic waves from the earpiece.

According to the embodiment, an antenna coil 4 is wound on the earpiece 1. The antenna coil 4 serves to wirelessly exchange data between a device that is incorporated into the earpiece 1 and a further device. The antenna coil 4 can be used both to send as well as receive an electromagnetic signal. The antenna coil 4 in the exemplary embodiment according to FIG. 1 is a coil with a center tap to detect on the three connection lines 5A, 5B, 5C. Two functions can thus simultaneously be achieved via the antenna coil 4: on the one hand, the antenna coil 4 can, as cited previously, be used as a send and/or receiving coil, and on the other hand, it can also supply a signal derived from the earpiece input signal, such that an electromagnetic signal (emitted by the earpiece 1 in spite of the electromagnetic shielding of the earpiece by the hearing aid housing) is largely compensated and the antenna signal is influenced as little as possible.

Figure 4:
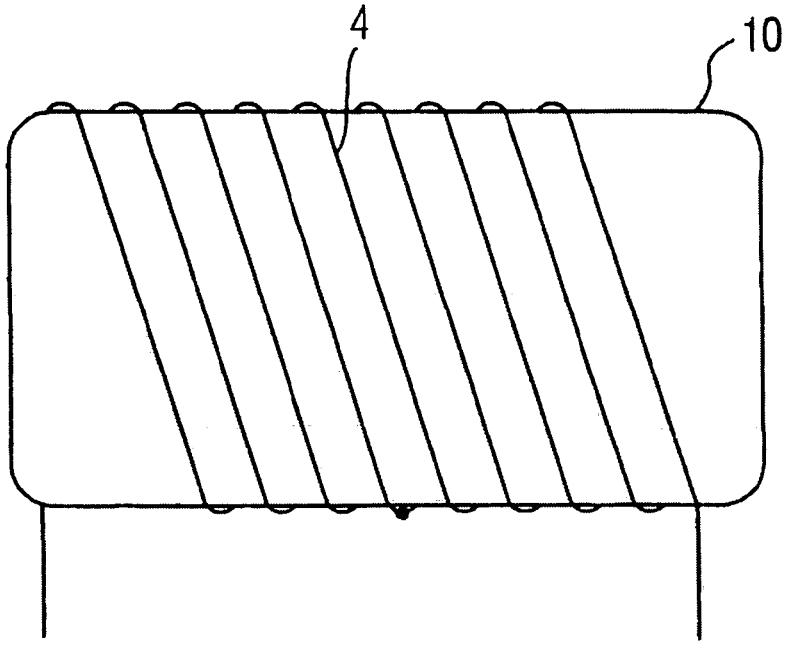
FIG. 4 is a pictorial block diagram showing an antenna coil wound around a microphone.
Figure 5:
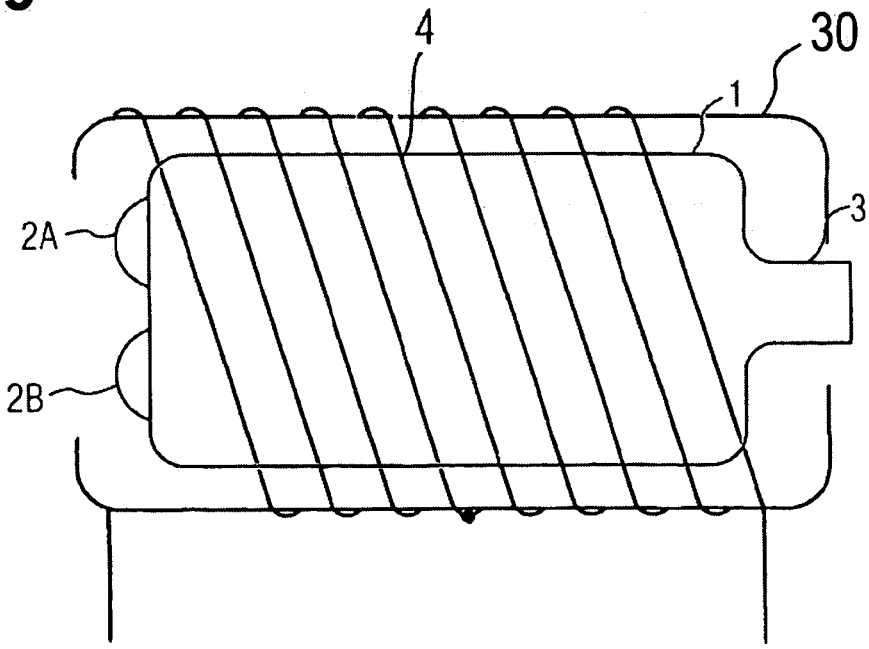
FIG. 5 is a pictorial block diagram showing an antenna coil wrapped around a shielding capsule.

In contrast to the shown exemplary embodiment, a compensation coil can also exist as an independent component (thus separate from the antenna coil 4) by which a compensation of the earpiece field is achieved. The compensation coil can be arranged in front of, next to, or behind the earpiece 1. Furthermore, the earpiece 1 can also be enclosed by an additional shielding capsule 30 (FIG. 4) within the hearing aid device. The antenna coil 4 according to the invention is then advantageously not directly wound around or on the earpiece 1, but rather around or on this shielding capsule 30. The shielding capsule 30 may be comprised of ferrite material, mu-metal, or an iron sheet. A comparatively large coil can also be arranged inside a hearing aid device almost without additional space requirement due to this feature.

Figure 2:
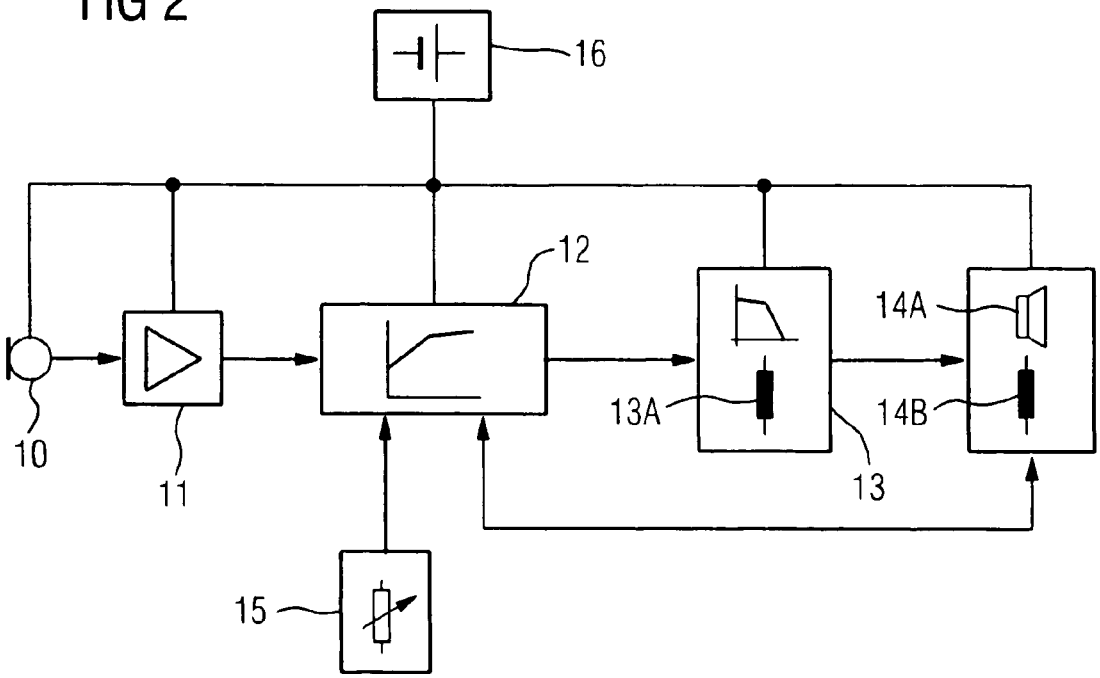
FIG. 2 is a block diagram of a hearing aid device with an antenna coil wound around or on the earpiece, a compensation coil, and an electric compensation circuit.

FIG. 2 shown in simplified, schematic depiction is the block diagram of a hearing aid device with an antenna coil according to an embodiment of the invention. The hearing aid device comprises a microphone 10 as an input transducer that acquires an acoustic signal and transduces it into an electrical signal. Furthermore, the hearing aid device comprises a signal processing unit 11, in which the microphone signal is, for example, A/D converted and pre-amplified.

In addition, a signal processing and control unit 12 is present in the hearing aid device to process and frequency-dependently amplify the electrical signal. The signal processing preferably ensues in the hearing aid device using a digital signal processor (DSP) whose mode of operation can be influenced by programs that can be transmitted to the hearing aid device as well as parameters that can be adjusted. The mode of operation of the signal processing can adapt both to the individual hearing loss of a hearing aid user and the actual auditory situation, in which the hearing aid device is directly operated.

A compensation unit 13 is downstream from the signal processing and control unit 12 in the signal path of the hearing aid device according to the device. The compensation unit 13 comprises a compensation coil 13A traversed by an earpiece current that is implemented such that it counteracts and compensates for the electromagnetic field generated by the earpiece 14A. In addition to the compensation coil 13A, the compensation unit 13 further comprises a compensation circuit that modifies the earpiece input signal according to amplitude and/or phase before it is supplied to the compensation coil 13A. The compensation circuit is advantageously implemented as an active or passive filter.

Furthermore, the hearing aid device according to FIG. 2 comprises an earpiece 14A around or on which an antenna coil 14B is wound according to the invention. The antenna coil 14B is connected with the signal processing and control unit 12 of the hearing aid device such that an electromagnetic signal can be received via the antenna coil 14B and further processed in the hearing aid device. In contrast, an electromagnetic signal can also be emitted from the hearing aid device, starting from the signal processing and control unit 12 via the antenna coil 14B. Given both a received signal and an emitted signal, it can be an audio signal or a data signal. "Data signals" are defined as signals that carry no audio information, but rather other information that, for example, serves to program or control the hearing aid device.

The hearing aid device according to FIG. 2 furthermore comprises an actuator 15, for example, a volume actuator, by which the signal processing in the signal processing and control unit 12 can be influenced. Finally, a battery 16 to supply voltage to the individual components of the hearing aid device is present in the hearing aid device.

Figure 3:
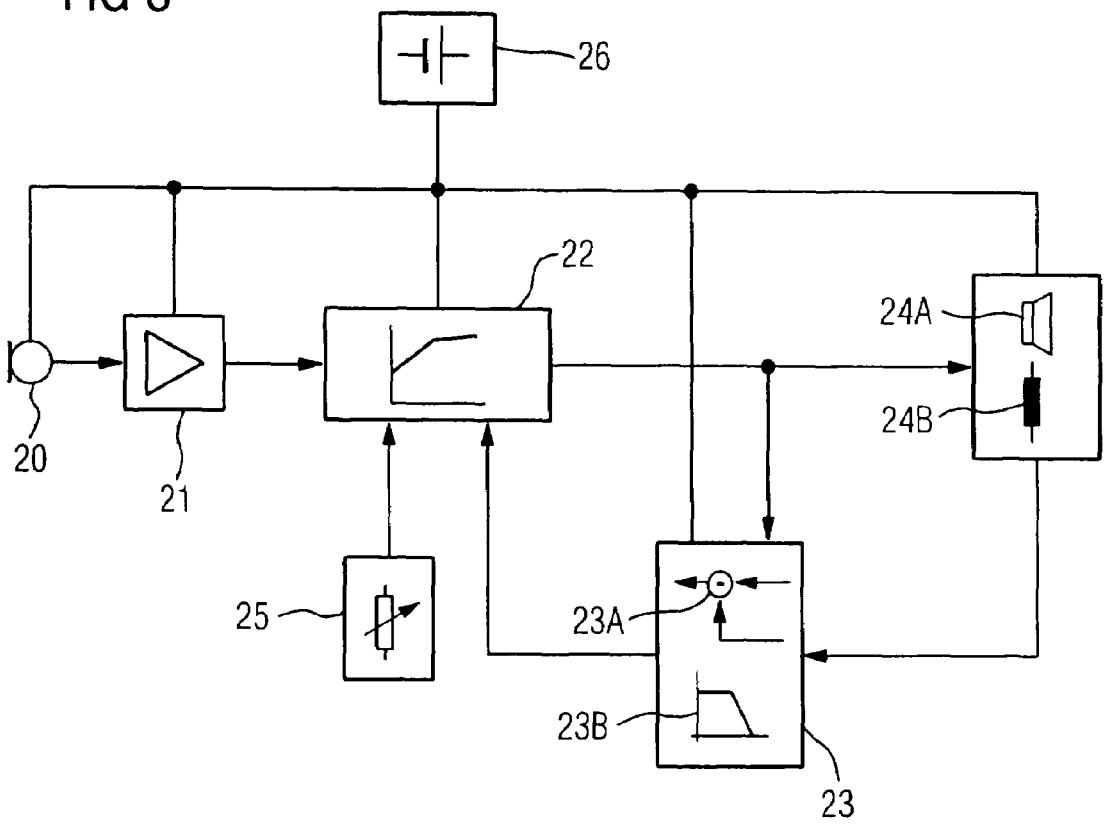
FIG. 3 is a block diagram of a hearing aid device with an antenna coil wound around the earpiece and a subtraction filter.

FIG. 3 shows a further exemplary embodiment of the invention. Similar to the hearing aid device shown in FIG. 2, it also comprises a microphone 20 to acquire an acoustic input signal and transduce it into an electrical signal, a signal processing unit 21 to A/D-convert and pre-amplify the input signal, a signal processing and control unit 22 to process and amplify dependent on frequency the electrical signal, an earpiece 25A around or on which an antenna coil 24B is wound, a volume actuator 25, and a battery 26 to supply voltage to the components of the hearing aid device.

Different than in the exemplary embodiment according to FIG. 2 in which an overcoupling of an electromagnetic signal generated by the earpiece 14A on the antenna coil 14B is prevented by a compensation unit 13 and in particular a compensation coil 13A, the exemplary embodiment according to FIG. 3 provides an electronic compensation of a noise signal transmitted from the earpiece 24A to the antenna coil 24B. In addition, the compensation unit 23 comprises, in particular, a subtraction filter 23A as well as a further filter 23B. The compensation unit 23 is supplied from both the electric signal supplied to the earpiece 24A and the electric signal emitted by the antenna coil 24B.

Since the antenna coil 24B is wound on the earpiece 24A, the signal transmission behavior from the earpiece 24A to the antenna coil 24B can also be precisely determined. Parameters of the compensation unit 23 can thereby by adjusted such that the signal portions coming from the earpiece 24A can be precisely determined in the output signal of the antenna coil 24B and subtracted from the output signal. Thus only the signal portions of the output signal of the antenna coil 24B that come from a signal source outside of the hearing aid device are supplied to the signal processing and control unit 22.

As in the exemplary embodiment according to FIG. 2, the parameters (in particular, filter parameters) of the compensation unit 23 can also be adjusted, for example, during the programming of the hearing aid device. However, these parameters can also be adaptively adjusted during the operation of the hearing aid device.

A compensation that is not influenced by the magnetic field of the earpiece is effected by the electronic compensation method. Furthermore, this type of compensation also presents a very energy-efficient solution.

In summary, an antenna coil is present in the hearing aid device to wirelessly transmit signals between a hearing aid device and a further device. Due to the required miniaturization of hearing aid devices, only minimal space is available for the arrangement of the antenna coil in the hearing aid device. The invention therefore provides to wind the antenna coil around or on an existing electro-acoustic transducer in the hearing aid device or around or on a capsule surrounding the transducer. A comparatively large antenna coil, for which little additional space is required, can thereby be provided in the hearing aid device.

For the purposes of promoting an understanding of the principles of the invention, reference has been made to the preferred embodiments illustrated in the drawings, and specific language has been used to describe these embodiments. However, no limitation of the scope of the invention is intended by this specific language, and the invention should be construed to encompass all embodiments that would normally occur to one of ordinary skill in the art. The particular implementations shown and described herein are illustrative examples of the invention and are not intended to otherwise limit the scope of the invention in any way. For the sake of brevity, conventional electronics, control systems, and other functional aspects of the systems (and components of the individual operating components of the systems) may not be described in detail. Furthermore, the connecting lines, or connectors shown in the various figures presented are intended to represent exemplary functional relationships and/or physical or logical couplings between the various elements. It should be noted that many alternative or additional functional relationships, physical connections or logical connections may be present in a practical device. Moreover, no item or component is essential to the practice of the invention unless the element is specifically described as "essential" or "critical". Numerous modifications and adaptations will be readily apparent to those skilled in this art without departing from the spirit and scope of the present invention.

REFERENCE LIST

| | |
|---|---|
| 1 | receiver |
| 2A, 2B | electric contacts |
| 3 | noise emission socket |
| 4 | antenna coil |
| 5A, 5B, 5C | connection circuits |
| 10, 20 | microphone |
| 11, 21 | signal processing unit |
| 12, 22 | signal processing and control unit |
| 13, 23 | compensation unit |
| 13A, 23A | antenna coil |
| 14A, 24A | receiver |
| 14B, 24B | antenna coil |
| 14, 25 | volume actuator |
| 16, 26 | battery |
| 23A | subtraction filter |
| 23B | filter |
| 30 | shield capsule or plate |

What is claimed is:

1. A hearing aid device configured to wirelessly transmit data between the hearing aid device and a further device, comprising:

a microphone configured to acquire an acoustic input signal and transduce it into an electrical signal;

a signal processing and control unit configured to process the electrical signal;

a receiver configured to transduce the electrical signal into an acoustic signal; and an antenna coil that is directly wound on the body of the receiver or the microphone of the hearing aid device, the antenna coil being configured to implement the wireless transmission of data.

2. The hearing aid device according to claim 1, further comprising:

a compensator configured to compensate a noise signal generated by the receiver and transmitted to the antenna coil.

3. The hearing aid device according to claim 2, wherein the compensator comprises a compensation coil configured to compensate the electromagnetic field generated by the receiver.

4. The hearing aid device according to claim 3, further comprising:

at least one of a shielding plate or a shielding capsule that shields or encloses the receiver respectively, the antenna coil being wound on the shielding plate or the shielding capsule, wherein the compensation coil is wound on the receiver, the shielding plate, or the shielding capsule.

5. The hearing aid device according to claim 3, wherein the antenna coil and the compensation coil are implemented as a coil comprising a center tap.

6. The hearing aid device according to claim 3, further comprising:

a compensation circuit that modifies an electric receiver input signal according to at least one of an amplitude and phase and feeds into the compensation coil.

7. The hearing aid device according to claim 6, wherein the compensation circuit is an active filter.

8. The hearing aid device according to claim 7, wherein the filter comprises an adjustment mechanism configured to permit filter parameters to be adaptively adjusted during operation.

9. The hearing aid device according to claim 6, wherein the compensation circuit is a passive filter.

10. The hearing aid device according to claim 9, wherein the filter comprises an adjustment mechanism configured to permit filter parameters to be adaptively adjusted during operation.

11. The hearing aid device according to claim 7, wherein the filter comprises filter parameters that can be statically selected.

12. The hearing aid device according to claim 9, wherein the filter comprises filter parameters that can be statically selected.

13. The hearing aid device according to claim 2, wherein the compensator is an electronic compensator, and further comprises a subtraction filter to compensate the noise signal generated by the receiver and transmitted to the antenna coil.

14. A hearing aid device configured to wirelessly transmit data between the hearing aid device and a further device, comprising:

a microphone configured to acquire an acoustic input signal and transduce it into an electrical signal;

a signal processing and control unit configured to process the electrical signal;

a receiver configured to transduce the electrical signal into an acoustic signal; and at least one of a shielding plate or a shielding capsule that shields or encloses the receiver respectively, the antenna coil being wound on the shielding plate or the shielding capsule of the hearing aid device.

15. The hearing aid device according to claim 14, wherein the shielding capsule is comprised of ferrite material, mu-metal, or an iron sheet.

* * * * *